US005570884A

United States Patent [19]

Carps

[11] Patent Number: 5,570,884

[45] Date of Patent: Nov. 5, 1996

[54] ERGONOMIC UNDERLAY FOR HAND GRIPS

[76] Inventor: Dan Carps, 25365 Leestock, Farmington Hills, Mich. 48336

[21] Appl. No.: 418,560

[22] Filed: Apr. 10, 1995

[51] Int. Cl.[6] ..... A63B 53/16

[52] U.S. Cl. ..... 473/298; 473/303

[58] Field of Search ..... 273/81.4; 473/298, 473/297, 303

[56] References Cited

U.S. PATENT DOCUMENTS

| | | | |
|---|---|---|---|
| 2,149,911 | 3/1939 | East | 273/81.4 |
| 2,690,338 | 9/1954 | De Brocke | 273/81.4 |
| 3,078,097 | 2/1963 | Mitchell | 273/81.4 |

*Primary Examiner*—George J. Marlo

[57] ABSTRACT

For use with sporting equipment having a handle shaft, such as golf clubs and baseball bats, a new and useful underlay material is self adhered to the area of the handle shaft designated for grasping, and used in conjunction with an external handle grip. The underlay material has self adhering surfaces and comes in stacks having a release paper sheet separate the individual underlays. The underlay materials come in a wide array of thicknesses and densities whereby each handle shaft can be custom fitted to its user, and can receive any standard overlay grip. The underlay materials are pre-cut to a designated handle size whereby one can choose the circumference of the handle shaft affording the greatest ergonomic value by first applying the self adhering underlay material to the handle shaft, then applying a small amount of solvent to its outer self adhering surface to act as a lubricant, a common handle grip is stretched over the underlay material until firmly seated thereto.

1 Claim, 5 Drawing Sheets

FIG. 4.
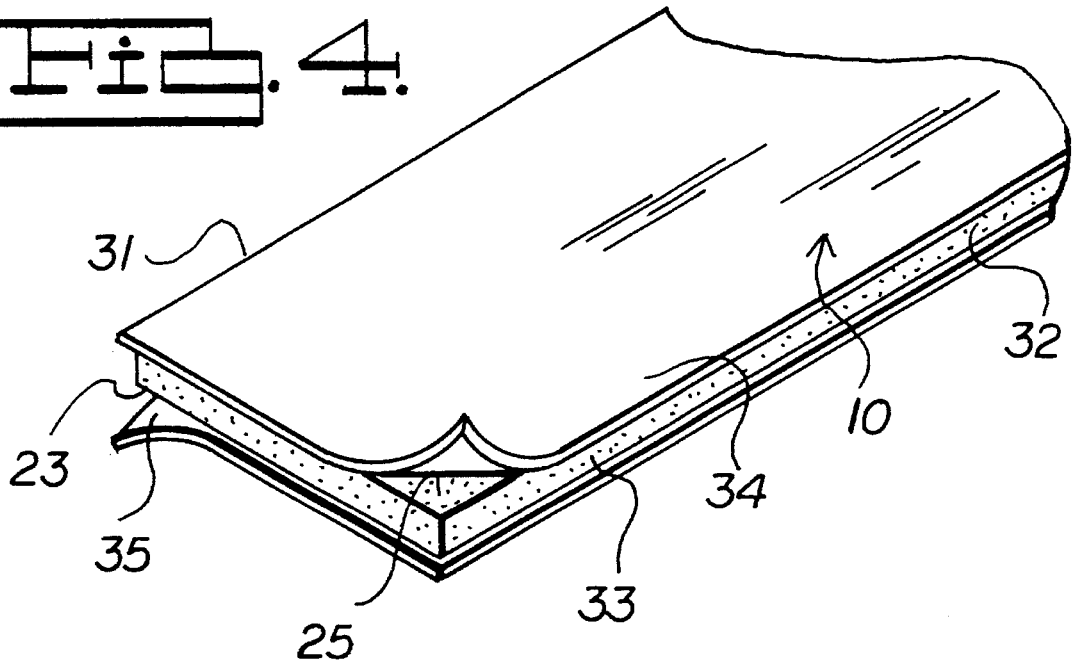
FIG. 5.
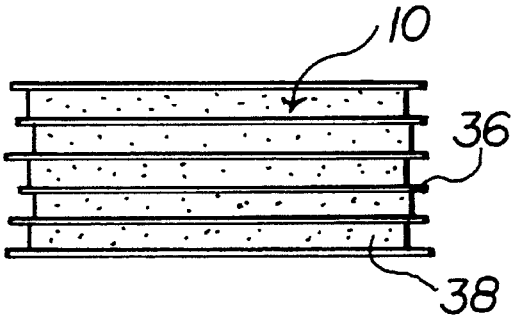
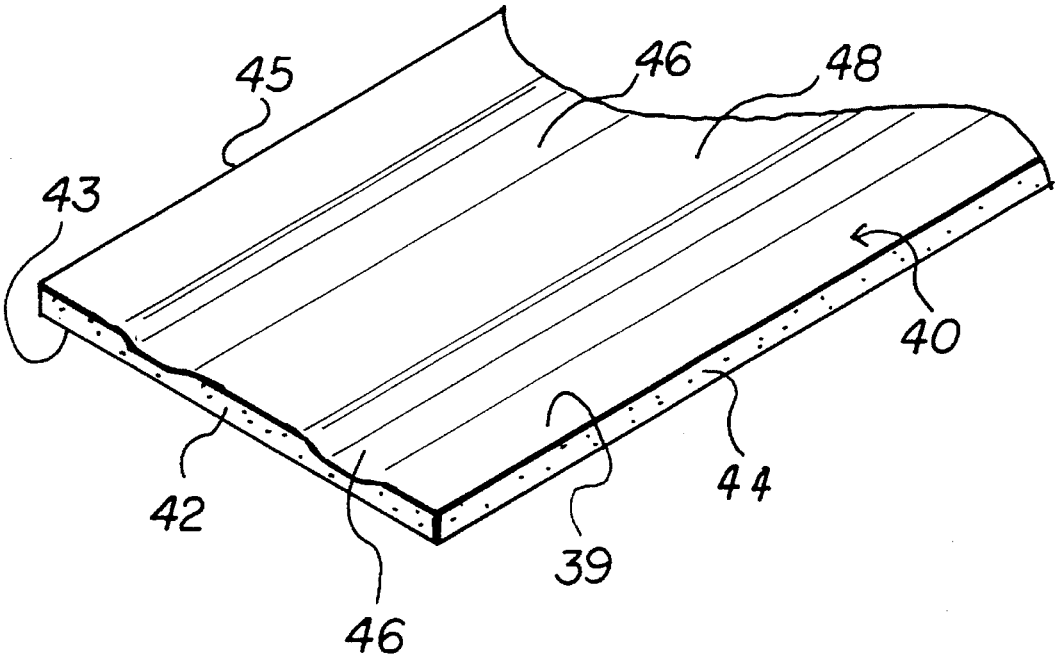
FIG. 6.

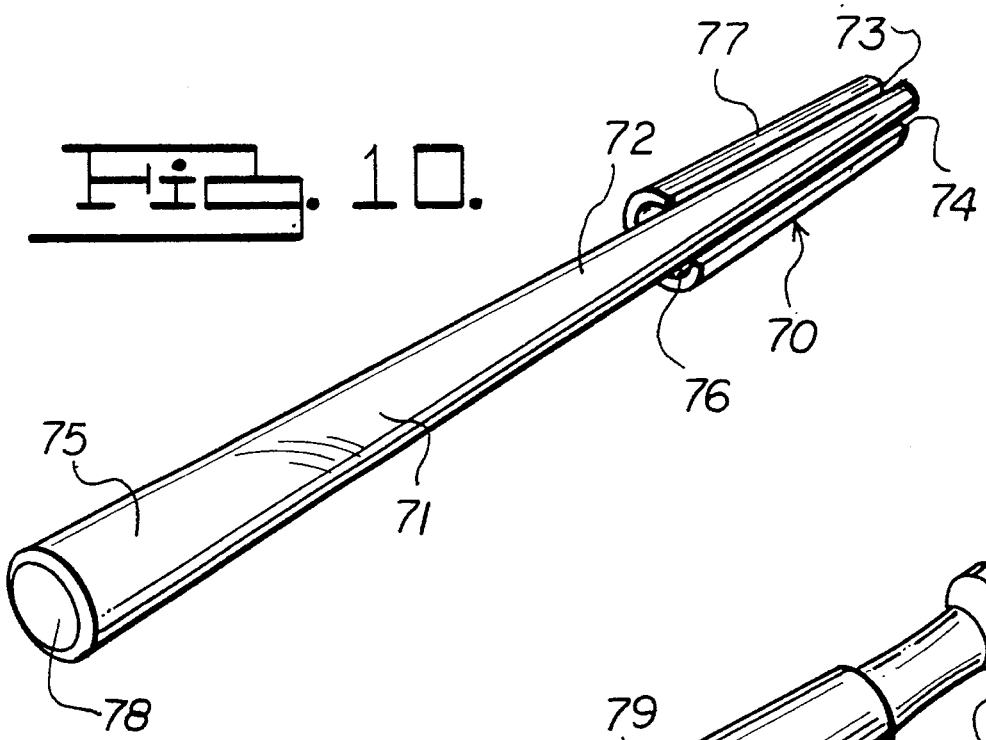
Fig. 10.
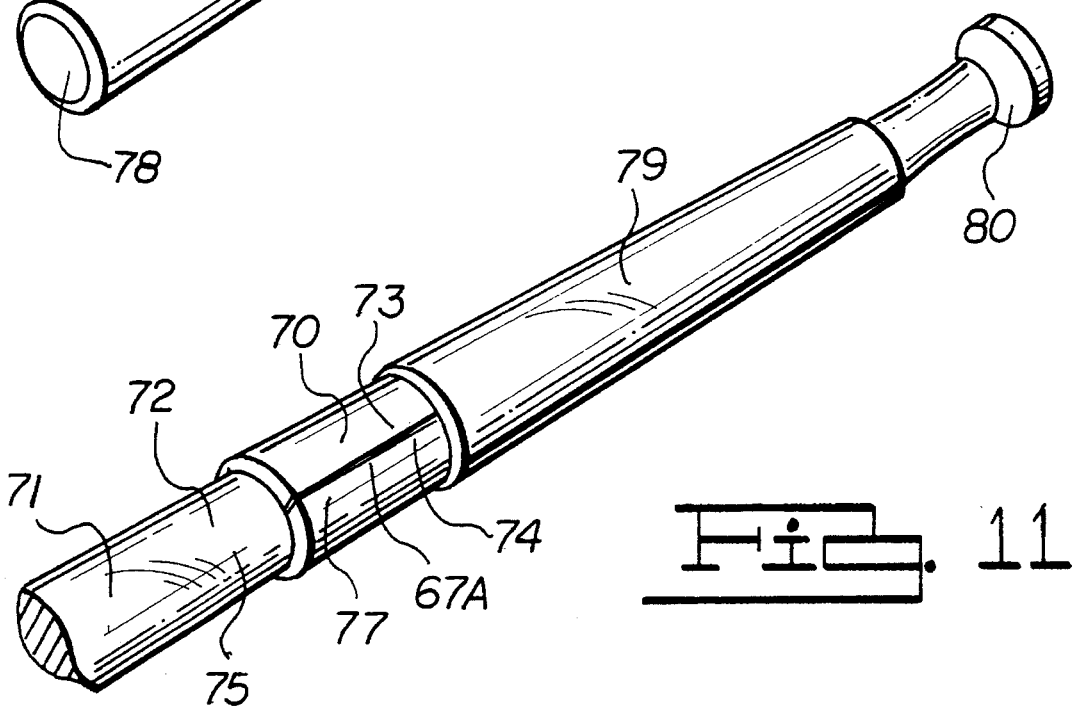
Fig. 11.
Fig. 12.
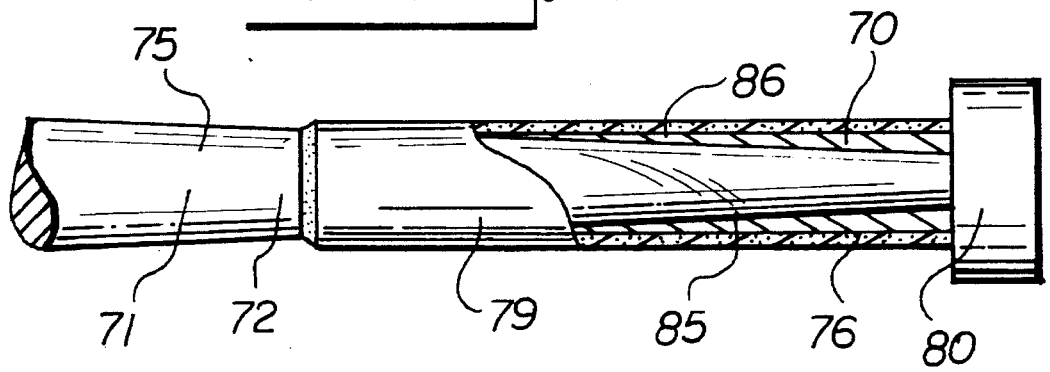

ERGONOMIC UNDERLAY FOR HAND GRIPS

TECHNICAL FIELD

This invention relates in general to self adhering wraps and sheets of materials used to space a hand grip, like those found on the various golf clubs, from handles.

BACKGROUND OF THE INVENTION

The application of the hand grip to the handle of a golf club requires that a layer of masking tape, both sides adhering, be installed to the end surface area of the golf club shaft. The grip has a weep hole centrally located in the butt surface which is plugged off. the grip is then filled with a solvent which loosens the adhering properties of the tape thereby acting as a lubricant allowing the grip to be slid over the handle of the club. Once the grip is seated, the plug is removed to drain any excess fluid. Once the solvent evaporates, the grip is bonded to the club handle.

The above process is common during new construction or to replace an existing hand grips.

In many cases golf clubs are available as "one size fits all". If one wanted to alter the thickness of the grip to better conform to their individual taste, they would either take their equipment to a golf pro shop, which cost alot of money, or order them custom from the factory, again costing alot of money.

The most common alteration to existing club handles is adding to the circumference of the handle with masking tape. Before the solvent loaded grip is installed, layer upon layer of masking tape is wound evenly along the hand grip area until the desired thickness is achieved. The grip is then expanded over the wraps. The entire process is very time consuming and costly.

Attempts have been made to offer golfers a series of retro-fit grips that are available in a wide range of thicknesses and styles. These grips also proved to be very costly thereby limiting their commercial success.

Another problem with using masking tape wraps as an underlying material is the rigidity of the wraps. To get the best posible swing of a golf club, one has to over compensate from any given factor depending on the characteristics of ones musculature.

Therefore, given the current state of the art, a new and useful means for preparing a golf club for receiving a hand grip is disclosed. A main object of the present invention is to provide sheets of underlying material already cut and formed so when adhered to a golf club handle, will automatically be set to a desired circumference.

Another object of the present invention is to provide a graduation of underlying sheets having self adhering sides seperable by layers of release paper.

Still another object of the present invention is to provide self adhering sheets of underlying material which is flat on one side to conform to the flat surface area of a golf club handle while having a contoured opposite surface which when installed, provides an oval grip having greater ergonomic value to those so desirous.

It is still a further object of the present invention to provide a self adhering underlay material having a wide array of densities whereas one may desire a stiffer hand grip than others. Said underlay material also made available in a broad spectrum of thicknesses most commonly adapted to the individual requirements of any given golfer.

In still another object of the invention, the afore-mentioned underlay materials are adapted for use with other sporting equipment such as base-ball bats and tennis rackets and even hockey sticks. All the above mentioned objects allow for the continued manufacture of a single common hand grip when used with solvent, expands and conforms to the underlay material then sets as the solvent evaporates.

SUMMARY OF THE INVENTION

In light of the foregoing problems, and to fulfill the above-stated objects there is provided, according to one aspect of the present invention, a graduation of designated underlying sheets for use as a substrate between a golf club handle and a hand grip to better allow any individual a custom grip thereby improving ones golf swing.

It is a foregone conclusion that many different golfers have an individual musculoskeletal system different from one another. Hand grips however are generally available in one common size. Disclosed is a sheet material already cut to fit the handle of the golf club. The material has release paper protecting the adhesive sides which is peeled away when installed to the golf club handle. Depending on which thickness the golfer prefers, the material is available in different densities or levels of firmness. For example, a smaller framed golfer may require a handle having a smaller circumference than say a larger framed individual.

The disclosed underlying material is well suited to be used as a retro-fit or as original equipment. In a retro-fit, the golfer will grip any number of predescribed handles each having a variable thickness of underlying material. After the preferred underlay is chosen, the retro-fitter cuts away the existing foamular type grips and discards. The existing underlay is then removed. The new underlay is then set in place on the club handle and the release paper removed. The new grip then has the hole in the butt end plugged off and is filled with solvent. Holding the solvent filled grip upright, the club is twisted and pressed downward into the grip opening. The solvent works on the adhesive turning it into a lubricant making the grip easier to install. Once the grip is seated, the plug is removed and the solvent drained out. Once the remaining solvent evaporates the adhesive sets up a rigidly binds the grip surface to the underlay surface.

As original equipment, a stack of underlay sheets is provided for each club belonging to that set. The underlays are set to the handles and the grips are plugged off as described above.

To offer broader ergonomic coverage of underlays, any given thickness of underlying material can be contoured to match any given request such as an oval shape.

It is foreseen then that the various underlying materials can apply similar parameters to baseball bats, hockey sticks and tennis rackets and the like, and with similar results. Indeed, it is far more cost effective to produce a wide array of underlying materials than it would be to produce that affect into each particular handle grip.

BRIEF DESCRIPTION OF THE DRAWINGS

In the drawings where like reference numerals are used to indicate identical components in the various figures:

FIG. 4 is a fragmentary perspective view of an underlying sheet depicting top and bottom release paper used to prevent additional sheets, so grouped together, from adhering to one another.

FIG. 5 is a side elevation of predetermined underlay sheet sizes, so grouped together, and separable by intermittent laminates of release paper.

FIG. 6 is a fragmentary perspective view of a pre-contoured underlay sheet.

FIG. 10 is a perspective view of a baseball bat having an ergonomically correct underlay material adhered to the handle portion of said bat.

FIG. 11 is a fragmentary perspective view of a baseball bat having an underlay material first adhered to the handle surface prior to the lateral insertion of a hand grip.

FIG. 12 is a fragmentary side elevation, in partial cross-section, of the handle area of a baseball bat showing the opposite displacement of a tapered underlay material thereby levelling the grip surface.

DETAILED DESCRIPTION OF THE EMBODIMENTS

Figure 1:
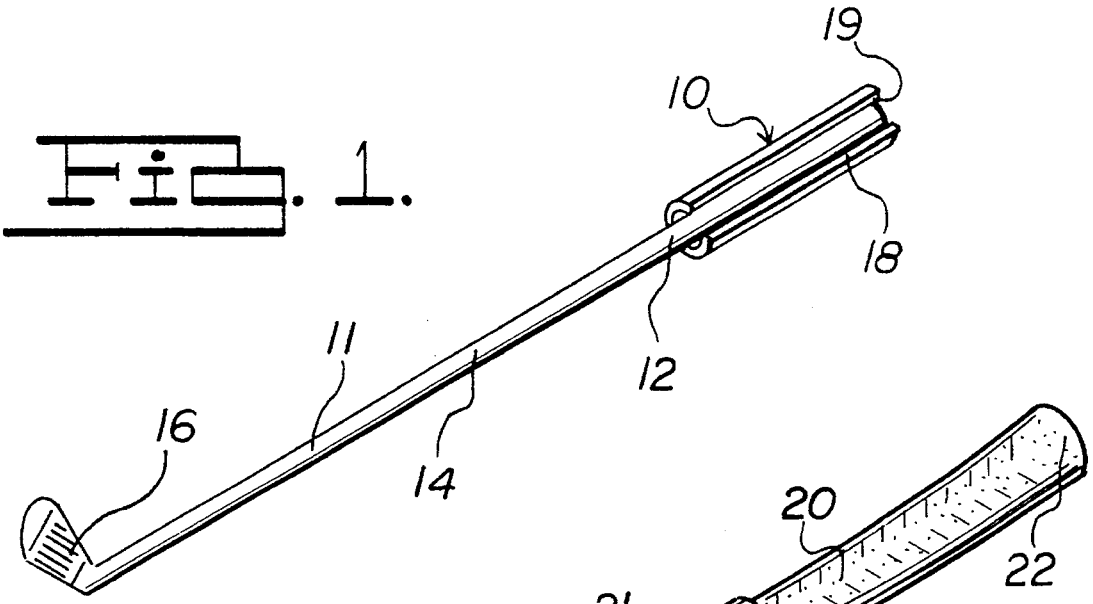
FIG. 1 is a perspective view of a golf club being fitted with a particular underlying material to the handle area.

With combined reference to all the Figures, an ergonomic underlay for hand grips is generally denoted by the numeral 10. As seen in FIG. 1 a golf club 11 comprises a head 16 mounted to a shaft 14 which terminates into a handle 12. The underlay 10, selected from a graduation of thicknesses and densities, is self adhering and is made to conform to the radius of the handle area 12 until edges 18 and 19 are abutted.

Figure 2:
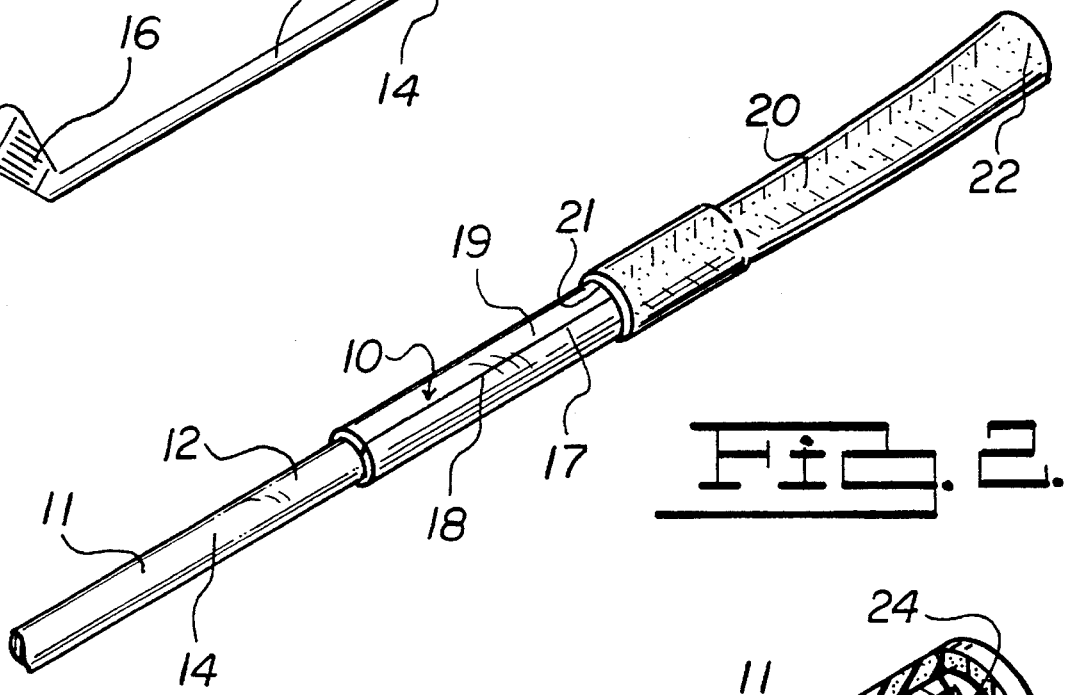
FIG. 2 is a fragmentary perspective view of a golf club handle having a underlying material adhered thereto and having a hand grip fitted over the underlay.

As viewed in FIG. 2, the underlay 10 is adapted to the handle area 12 of a shaft 14 comprising the linear portion of a golf club 11. The underlay 10 is conformed to the handle 12 by drawing a first edge 18 against a second edge 19 to create a common seam 17. A hand grip 20 is then filled with a solvent (not viewed), which acts as a temporary evaporable lubricant. The grip 20 has an opening 21 which is then manually expanded over, and onto the underlay 10 until the butt end 22 of the grip 20 bears against the terminal end surface of the handle area 12.

Figure 3:
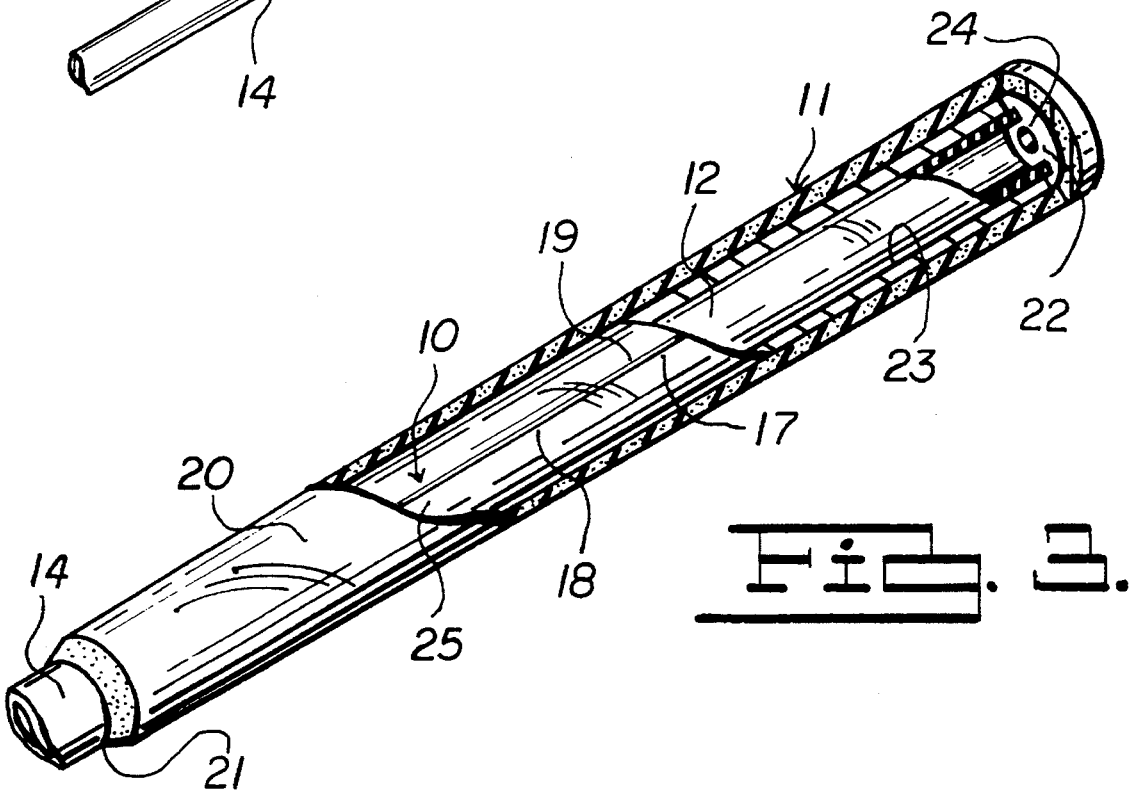
FIG. 3 is a fragmentary cut-away view of the relationship between handle underlay and hand grip respectively.

As seen in FIG. 3, the handle area 12 of the golf club 11 and shaft 14 is enveloped by the underlay material 10 by mating a first edge 18 with a second edge 19 to form a seam 17. The underlay 10 is first bonded to the handle area 12 by the self adhering inner surface 23, then oppositely bonded to a hand grip 20 by means of a self adhering outer surface 25. Prior to adapting the grip 20 to the underlay 10, the butt end 22, which has an aperture 24 centrally displaced thereat is filled with an evaporative solvent, after the aperture 24 is plugged off. The free opening 21 of the grip 20 is then manually expanded over the underlay 10 until seated.

As seen in FIG. 4, the underlay 10 comprises a sheet of resilient material 32 which is available in a variation of densities and thicknesses, said underlay having a first surface 25 and a second planer surface 23, both being self-adhering. To prevent the self-adhering surfaces 23 and 25 from accidental bonding, a first releasable laminate 34 and a second releasing laminate 35 are disposed over their respective surfaces. The linear edges 31 and 32 are non adhering.

As viewed in FIG. 5, a plurality of underlay sheets 30, having a common density and thickness, are separated by a releasing laminate 36 which are peeled away at the time of installation, and tend to keep the self adhering resilient underlay sheets 30 oriented during use. As viewed from an end elevation, the edges 38 are non adhering.

Seen in FIG. 6, the underlay 40 comprises a core 42 having a first linear side edge 44 and a second linear side edge 45. The core 42 has a planer sub-surface 43 which is self adhering, and a top self adhering surface 39 having low surface points 46 evenly displaced between high surface points 48, which when install to the radius of a golf club (not here viewed), create an oval configuration.

Figure 7:
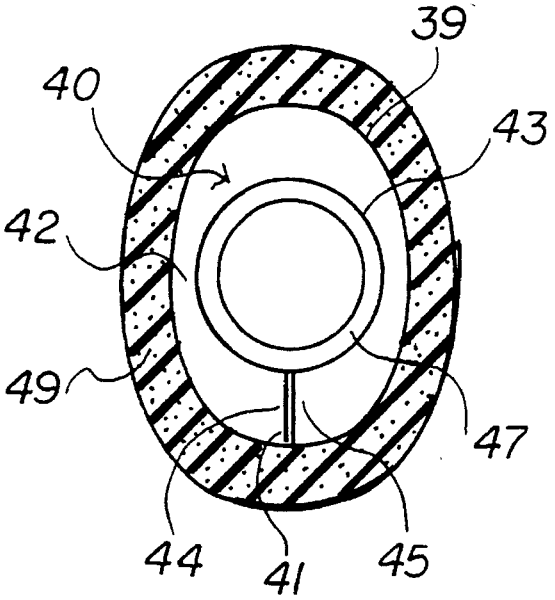
FIG. 7 is a top plan view, in cross-section, of a pre-contoured underlay material as a self adhering laminate between a golf club handle and hand grip.

Now as viewed from a top plan in FIG. 7, the ovally oriented underlay 40 comprising a core 42 having a sub self-adhering radial surface 43 engaged with the radial outer surface of a golf club handle 47. The first linear side edge 44 and the second linear side edge 45 are interfaced to create a common seam 41. The self ad hering outer surface 39 is then bonded to a hand grip 49.

Figure 8:
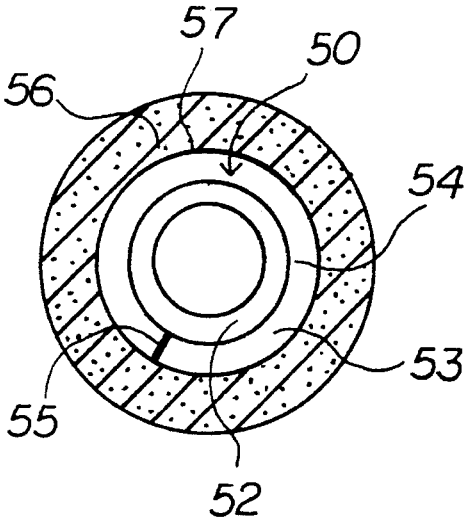
FIG. 8 is a top plan view, in cross-section, of a self adhering laminate disposed central of a golf club handle and hand grip.

As seen in FIG. 8, an underlay 50 comprises a resilient core 53 which has a self-adhering sub surface 54 radially adapted to a golf club handle 52. Applied to the handle 52 from a planer sheet rolled around the handle 52 to form a seam 55, the core 53 further comprises a self-adhering outer surface 57 adapted for communication with a hand grip 56.

Figure 9:
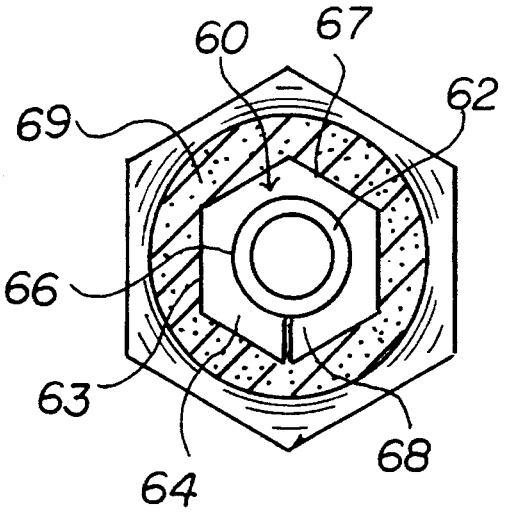
FIG. 9 is a top plan view, in cross-section, of a self adhering underlay having a conforming inner plane surface oppositely transitive from a geometrically interrupted planer surface.

In FIG. 9, an underlay 60 comprises a core 64 having a self-adhering sub surface 66 bonded to a golf club handle 62. Again installed from a planer sheet, the core 64 is radially applied to a common seam 68 and has a self-adhering outer surface 67 adapted to form a hexagonal perimeter 63 which is bonded to a hand grip 69. The hexagonal nature of the underlay 60 is transmitted through the hand grip 69 and helps a golfer maintain club head orientation with respect to driving a golf ball to a predetermined directional point.

With respect to FIG. 10, wherein an underlay 70 has a self-adhering sub surface 76 adapted for adherment to the surface 75 of a baseball bat 71 and handle 72. The underlay 70 has a first edge 73 brought around to interface with a second edge 74. A self-adhering surface 77 is then created opposite of the bat end 78.

As seen in FIG. 11, an underlay 70 is displaced over the handle area 72 of a baseball bat 71 for receiving a resilient hand grip 79. Radially installed from a sheet, the underlay 70, having a first linear side edge 73 matable to a second linear side edge 74 to form a common seam 67A, has a solvent laden hand grip 79 expanded over the underlay 70 until the handle grip knob 80 is seated against the handle shaft 75, and the adhesive surface 77 bonds to the hand grip 79.

As viewed in FIG. 12, the underlay 70 comprises a tapered core structure 86 which levels off the conical slope of the shaft 75. The underlay 70 has a self-adhering sub surface 85 which rigidly bonds the tapered core structure in place on the shaft 75. The underlay 70 then has a self-adhering outer surface 76 which bonds to the hand grip 79 thereby maintaining the constant position of the hand grip knob 80 to the handle 72 of the baseball bat 71.

Figure 13:
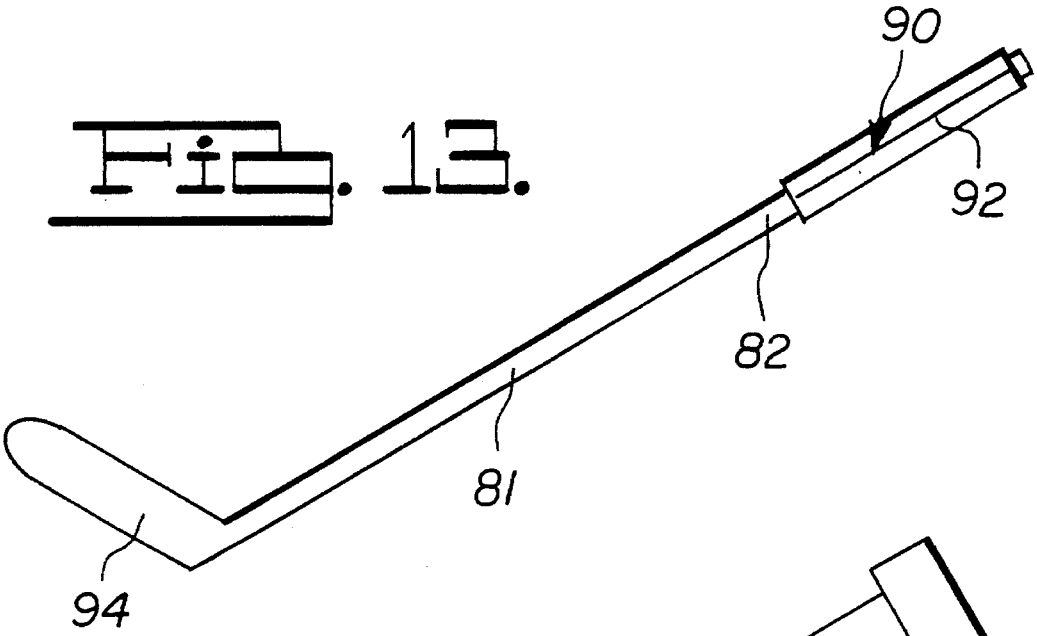
FIG. 13 is side elevation of a hockey stick having a self adhering underlay material positioned at the upper hand grip area, and prior to, the installation of a hand grip.

Now as viewed in FIG. 13, an underlay 90 is applied to a hockey stick 81 from a sheet and closed at a seam 92. Oppositely, the hockey stick 81 comprises a handle shaft 82 terminating with a blade member 94

Figure 14:
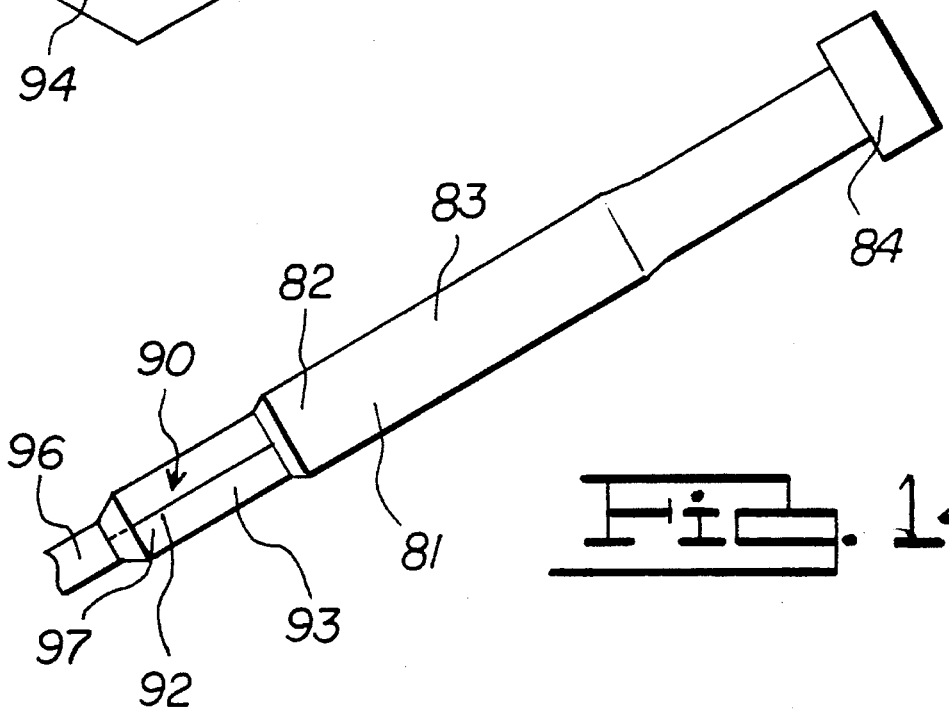
FIG. 14 is a fragmentary side elevation of an adhered underlay material adapted for communication with a hand grip.

As seen in FIG. 14, an underlay 90 comprises a core 93 with a transecting seam 92 which has a self-adhering outer surface 97 which is adapted to rigidly bond a hand grip 83 over the underlay 90 and to the handle 82 portion of the hockey stick 81 shaft 96 thereby maintaining the constant placement of the hand grip knob 84

Figure 15:
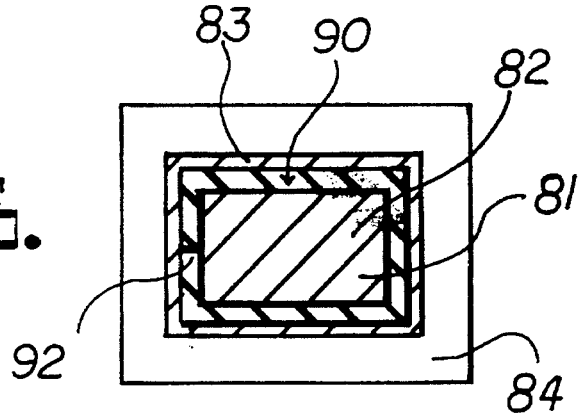
FIG. 15 is a top plan view, in cross-section, depicting an underlay material self-adhered between a handle shaft and grip.

In FIG. 15, the underlay 90 is bonded to the handle 82 of the hockey stick 81 and laminated oppositely to the hand grip 83 which is centrally interior of the hand grip knob 84. Said underlay 90 equalaterally terminates in cross-section with a common seam 92.

While the foregoing embodiments of the present invention are well suited to achieve the above stated objects, those skilled in the art should realize that such embodiments are subject to change, modification or alteration without departing from the scope of the present invention. For example, it is obvious that the sheets of underlay material could form one cylindrical section which would be slid over top of sporting equipment handles. As another example, it would be obvious that the underlays could be extruded from composites thereby creating varying graduations of "shims" which would then be manually adhered to any given substrate.

As another example, as the underlays are offered in blocks of sheets already cut to fit a particular application, said blocks could be color-keyed for quicker visual identification. For example, the eighth inch elevation with medium hardness could be designated as having blue release paper, and so on.

Other variations will no doubt occur to those skilled in the art upon the study of the description and drawings contained here in. Accordingly, it is to be understood that the present invention is not limited to the specific embodiments described herein, but should be deemed to extend to the subject matter defined by the appended claims, including all fair equivalents thereof.

I claim:

1. For use with a golf club having a standard hand grip, an underlayment comprises a foamular sheet having an inner and outer adhesive surface, said inner surface adhering to the handle shaft of said golf club, whereas said outer surface adhering to, and receiving of said standard hand grip, wherein said foamular sheet further comprises:

a plurality of pre-cut segments separated by a release paper sheet, said segments adapted for adhesion to the radius of a golf club handle, wherein said segments comprise a plurality of thicknesses for customizing the circumference of said golf club handle to the hand of a golfer while using one standard sized outer handle grip; and;

wherein said pre-cut segments comprise a plurality of densities and outer surface contours for further customizing said golf club handle, said outer hand grip resiliently conforming to said pre-cut segments to facilitate a desired ergonomic fit to the hand of said golfer.

* * * * *